US009492023B2

(12) United States Patent
Paulat

(10) Patent No.: US 9,492,023 B2
(45) Date of Patent: Nov. 15, 2016

(54) WIND AND SAND RESISTANT BEACH BLANKET

(76) Inventor: Lindsey Paulat, Hallandale, FL (US)

( * ) Notice: Subject to any disclaimer, the term of this patent is extended or adjusted under 35 U.S.C. 154(b) by 0 days.

(21) Appl. No.: 13/597,102

(22) Filed: Aug. 28, 2012

(65) Prior Publication Data

US 2014/0059763 A1 Mar. 6, 2014

(51) Int. Cl.
*A47G 9/06* (2006.01)

(52) U.S. Cl.
CPC ..... *A47G 9/062* (2013.01)

(58) Field of Classification Search
CPC .. A47G 9/062; A47G 9/0246; A47C 27/003; A47C 31/10
USPC ..... 5/417, 419, 420, 485, 496, 502, 656; 383/4
See application file for complete search history.

(56) References Cited

U.S. PATENT DOCUMENTS 2,162,755 A * 6/1939 Shauer ..... 5/497
2,659,421 A * 11/1953 Wass et al. ..... 5/657.5
4,272,575 A * 6/1981 Egigian ..... 428/83
4,461,048 A * 7/1984 Allaire, Jr. ..... 5/497
4,690,585 A * 9/1987 Holmberg ..... 405/19
4,703,530 A * 11/1987 Gusman ..... 5/497
5,007,123 A * 4/1991 Salyards ..... A47C 27/005 5/483
5,029,353 A * 7/1991 Kimball et al. ..... 5/497
5,406,659 A * 4/1995 Camp ..... 5/417
5,499,411 A * 3/1996 Wong ..... 5/417
5,740,566 A * 4/1998 Stacy ..... 5/420
6,192,536 B1 * 2/2001 Connors ..... 5/417
6,742,203 B2 * 6/2004 Reynolds ..... 5/420
6,988,283 B2 * 1/2006 Griffin ..... 5/497
7,120,952 B1 * 10/2006 Bass et al. ..... 5/484
7,174,585 B1 * 2/2007 Sorrentino et al. ..... 5/417
2004/0016054 A1 * 1/2004 Reynolds ..... 5/420
2005/0193490 A1 * 9/2005 Macdonald ..... 5/500
2006/0117480 A1 * 6/2006 Younce ..... 5/417
2008/0052827 A1 * 3/2008 DeIntinis ..... 5/417
2012/0284917 A1 * 11/2012 Nirmel ..... A47G 9/0238 5/417
2013/0061394 A1 * 3/2013 Joo et al. ..... 5/499
2013/0167296 A1 * 7/2013 Smith ..... A47C 31/105 5/484
2013/0254988 A1 * 10/2013 Overbey ..... 5/417

* cited by examiner

*Primary Examiner* — David E Sosnowski
*Assistant Examiner* — Myles Throop
(74) *Attorney, Agent, or Firm* — The Concept Law Group, P.A.; Scott D. Smiley; Erin A. Martin

(57) ABSTRACT

A beach blanket for use on the sand that resists being blown around by the wind. It comprises a main panel of fabric that the user can lay upon. On the bottom side of the main panel is a plurality of scoops that can be anchored by digging into the sand prior to use. Scoops are anchored at opposing points so that tension is applied to the main panel. If sand is blown onto the top of the main panel a point on the top of the main panel may be plucked thereby ejecting the sand off of the side of the main panel.

10 Claims, 4 Drawing Sheets

WIND AND SAND RESISTANT BEACH BLANKET

BACKGROUND OF THE INVENTION

1. Field of the Invention

The present invention relates to beach blankets, and more particularly, to a blanket that resists overturning from the wind and provides a grit free sunbathing experience.

2. Description of the Related Art

Several designs for beach blankets or towels have been designed in the past. None of them, however, include a simple yet robust means to easily secure a beach blanket to the sand so that the wind will not be able to pick up an edge and so that the blanket remains taut, which in turn allows for the easy ejection of sand from the surface.

Applicant believes that one relevant reference corresponds to U.S. Pat. No. 5,110,219 issued to Lopes. However, it differs from the present invention because the Lopes device uses external disc anchors to hold the edge of a mat that tend to dangle and can be troublesome when not used as a mat, are unnecessarily complicated and can be easily damaged. Additionally, this patent does not permit sand to be ejected in the manner and with the ease that the subject design permits.

Another relevant reference is demonstrated in U.S. Pat. No. 6,192,536 issued to Connors. However, the Connors device differs from the present invention because the Connors device weighs down a towel with pockets in the corners which will tend to get sand on the top side of the towel, where it is not desired. Also, the Connors device, by having sealable pockets, has moveable parts that are subject to wear, tear and ultimate failure. Whereas, the present device has no moving parts to wear out or fail. Further, the present device is adapted for easy anchoring onto the sand without soiling the topside of the device and for ease of ejection of sand on its top surface.

Another relevant disclosure is U.S. Pat. No. 6,721,973 issued to Cristiano. The Cristiano patent differs from the present device in that it has anchor pockets that fail to prevent wind from picking up the edges of a blanket. Cristiano also fails to provide an effective means to set the anchor pockets into the ground without getting substantial amounts of sand on top of the blanket where it is not wanted.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a beach towel that lays flat on the sand in windy conditions.

It is another object of this invention to provide a clean, grit-free sunbathing experience.

It is still another object of the present invention to provide a beach blanket that is easy to reliably secure to sand yet is easily removed once the beach time is over.

Another object of the present invention is to provide a beach towel that is readily machine washable.

Another object of the present invention is to have a wind-proof beach blanket that has no moving parts to break or to wear out.

It is yet another object of this invention to provide such a device that is inexpensive to manufacture and maintain while retaining its effectiveness.

Further objects of the invention will be brought out in the following part of the specification and in the drawings, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION

Figure 1:
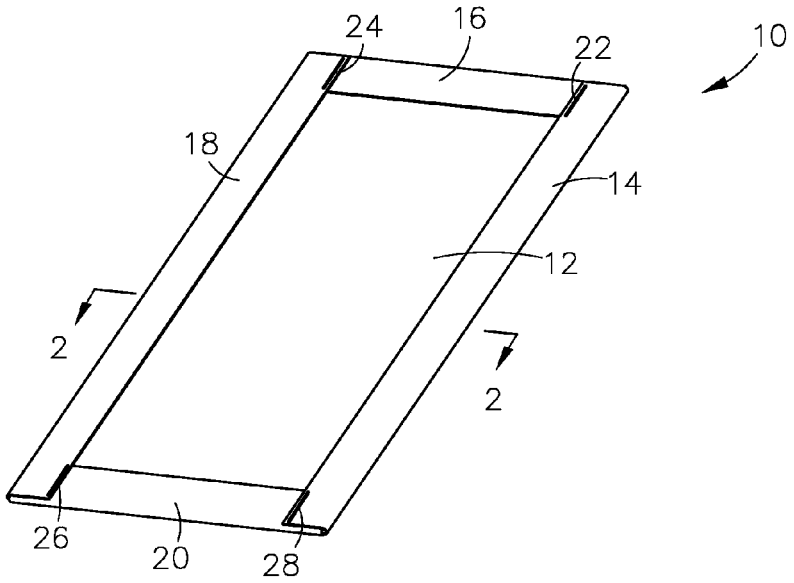
FIG. 1 represents a perspective view of the bottom side of a wind-proof beach towel.

It should be appreciated that the present invention is sometimes referred to as the device, invention, disclosure, blanket, towel or other common reference. Similarly, the term scoop and scoop generally characterizes similar structures in the device and may be used interchangeably. The masculine is intended to include the feminine and neuter. The singular or plural should be applied as appropriate as required by the context.

The examples contained and described herein are examples, some of which are included in a preferred embodiment. Many of the features and aspects of the invention may be combined or mix-and-matched to be combined with other features, the combination of which may constitute a valuable variation of embodiment of the device.

Depending on the application of the device some or other features may be more desirable than others so the actual preferred embodiment may thus change depending on circumstances and environmental conditions beyond the scope of this invention yet may have an effect on the invention that may affect which features are preferred.

Nearly everyone has gone to the beach to relax, take in some sunshine and enjoy the views. Some bring chairs to sit in but the majority have some sort of towel or blanket on which they rest.

In typical fashion, upon arriving to the beach and selecting a suitable location on the beach, a beach blanket is spread. On some days this poses little to no problems other than a sun burn. However, the beach is frequently a breezy place. The winds coming off a lake or ocean can wreak havoc upon a well-placed and properly smoothed out blanket on which to lie down.

The rarely ceasing wind at the water's edge blows about and can pick up an edge of that beach blanket and ruin a perfect spread. An improved device and method are disclosed herein to solve this problem. Further, the same blowing wind, whether curling over the edges of your beach blanket or not, will scatter sand all over its sunny side that can cause an abrasive situation. This same disclosed device and method can readily solve this issue as well.

Referring now to the drawings, where the present invention is generally referred to with numeral 10, it can be observed that it basically includes, inter alia, a panel 12, a scoop 14, a scoop 16, a scoop 18, a scoop 20, a seam 22, a seam 24, a seam 26 and a seam 28.

In normal use a top side of the panel 12 is faced upwards, towards the sun. FIG. 1 shows a version of the device up-side-down so that the several features nearer to a bottom side of the panel 12 may be understood in context. The scoop 14, scoop 16, scoop 18 and scoop 20 generally surround the periphery of the bottom side of the panel.

A seam 22 connects scoop 14 and scoop 16. A seam 24 connects scoop 16 and scoop 18. A seam 26 connects scoop 18 and scoop 20. A seam 28 connects scoop 20 and scoop 14. Typically each of the seams 22-28 are sewn using traditional sewing methods. Said seams 22-28 may also be made of other means such as adhesives, heat welding, stapling or other known methods of connecting a fabric to another fabric. None of the seams 22-28 are sewn or otherwise affixed to the panel 12.

In direct contrast to what may be used for a typical bed mattress sheet, in an important variation of the device there is very little depth character between the scoops 14-20 and the panel 12. In other words, when the scoops 14-20 are configured as shown in FIG. 1 there are very small pleats that form in the corners between adjacent scoops 14-20.

Figure 3:
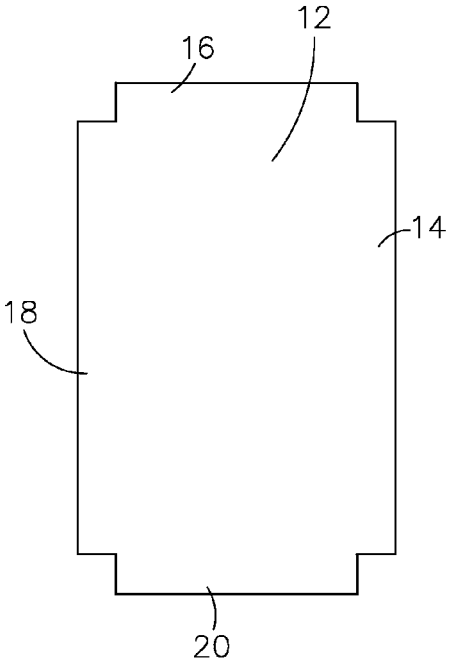
FIG. 3 illustrates a plan view of a cut diagram of the device prior to final assembly.

FIG. 3 is generally an example of a cut pattern for constructing the device. As can be seen, it is essentially made from a single sheet of material. The panel 12 is formed from the central portion of the material. The scoop 14, scoop 16, scoop 18 and scoop 20 are folded over onto the bottom side of the panel and affixed to each other at seam 22, seam 24, seam 26 and seam 28 to form essentially a continuous flap around the perimeter of the bottom side of the panel.

Figure 2:
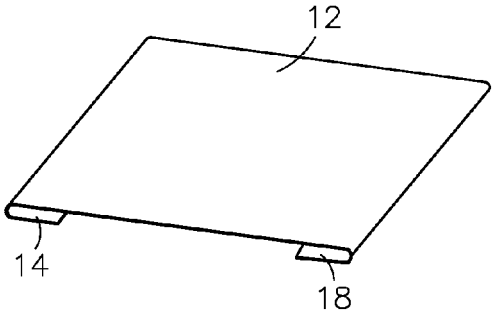
FIG. 2 shows a perspective cross-section view, at cross-section lines shown in FIG. 1.

Looking now at FIG. 2 where a cross-section (based on the cross-section plane identifiers in FIG. 1) of the invention is shown. It can be seen that the scoop 14 and opposing scoop 18 are laid substantially parallel the bottom side of the panel 12.

In use, the bottom side of the panel 12 is laid onto the sand. Sand is first scooped into the four corners. The panel 12 is spread out over the sand so that there are no (or minimal) wrinkles in the panel. The user then grasps any of scoops 14-20 and scoops sand to the area between that scoop, for instance scoop 14, and the panel 12. The opposing scoop, in this example scoop 18, is then scooped under the sand to fill the space between the scoop 18 and the panel. With opposing scoop 14 and scoop 18 anchored in the sand the panel 12 is tensioned between those scoops of sand. To fully secure the device to the sand in preparation for use, the process continues to scoop sand between another point along any of the scoops 14-20 and then the corresponding opposite scoop to tension the panel 12 between opposite points.

After multiple opposing points around the periphery of the panel 12 are stuffed with sand it becomes apparent that the device is then firmly affixed to the sand. There is little to no opportunity for the wind to intrude between the sand and the device and pick up an edge of the device. The device thereby becomes essentially wind proof.

Another benefit of tensioning the blanket onto the sand is recognizable when the blanket is secured onto the sand and some sand lands on the top side of the panel 12. It is then easy to clean off the top of the device by pinching the panel 12 at about the center point between the user's fingers and snapping the device up. When doing this the edges of the device remain secured to the sand and the sand on the top side of the device is flung off the edges of the blanket and thereby clearing the top side of the device.

In a preferred version of the device, the panel 12 is constructed of fabric. The fabric can be woven, knit or other non-woven material. The material of the panel 12 is preferably absorbent, at least on the top side. The absorbent nature of the panel 12 can soak up liquid as well as having a soft skin contacting layer.

Another important version of the device is one that, in addition to having some or all of the features described herein, is made of a single layer of fabric. This fabric can be absorbent to improve the comfort of the user and also without a nap so that sand will be less likely to adhere to the device when the device is no longer being used and is being prepared for transport and/or storage. On the other hand, it may be simpler to construct the entire device from a single piece of terry cloth, with a looped nap on both sides of the device.

In some preferred versions of the device a non-absorbent nature of the panel 12 is preferred. Typically, a non-absorbent layer will also be smooth and therefore be resistant to the adherence of sand. The non-absorbent nature of the panel 12 may also be preferred when the sand is wet, perhaps after a passing sudden rain. A further variation of the panel 12 is to be constructed of an impermeable material.

It may be preferred to have a lamination of multiple types of materials, each with a distinctive characteristic. For example, an impermeable or non-absorbent layer may be preferred on the bottom side of the panel 12 combined with a softer or more absorbent layer on the top side that will contact the users skin. The panel 12 may equally be made of a single material that may reduce the costs and complexity of manufacture of the device.

Figure 4:
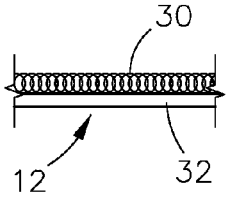
FIG. 4 is a representation of partial cross-section of an example of a layered construction.

Now referring to FIG. 4 where a partial cross-section of a version of the panel 12 is exemplified to have, inter alia, a nap 30 and a substrate 32. In this variation the top side of the panel 12 is shown as the nap 30. For example, the nap 30 can be a terry cloth type of loop combined with a smooth substrate 32. This is also sometimes referred to a French terry with a looped nap on one side and smooth on the other. The smooth side can inhibit the adherence of sand and other unwanted debris to the underside of the panel 12.

Figure 5:
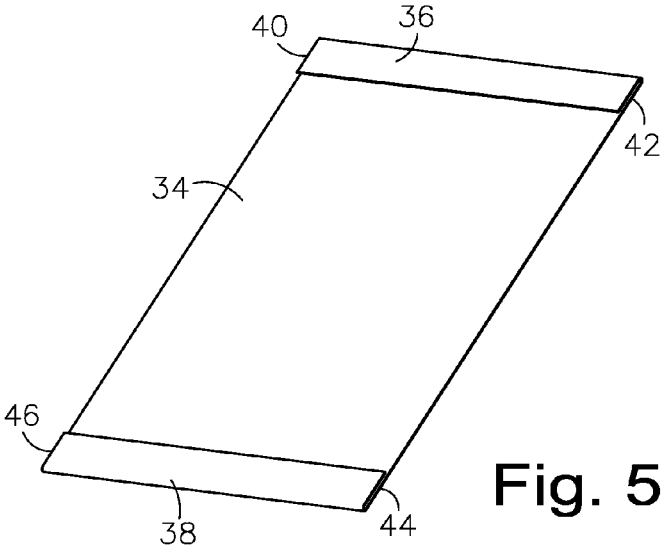
FIG. 5 shows a perspective view of a bottom side of an alternate version of the device.

FIG. 5 shows an example of an alternate version of the device that is comprised of, inter alia, a panel 34, a scoop 36, a scoop 38, a seam 40, a seam 42, a seam 44 and a seam 46. The construction and dimensions of the version of the device as shown in FIG. 5 is similar to that of the version exhibited in FIG. 1. The main distinguishing features are in the configuration of the scoops 36 and 38.

The scoop 36 is generally at a head end of the panel 34 and scoop 38 is generally at a foot end of the panel 34. These scoops 36 and 38 are folded over from surplus material of the panel 34. Seams 40 and 42 affix the respective edges of the scoop 36 to edges of the panel 34 at the head end. Similarly, seams 44 and 46 affix the respective edges of the scoop 38 to the edges of the panel 34 at the foot end.

By this means, the scoops 36 and 38 essentially form a pocket that lays flat on a bottom side of the panel 34. The panel 34 in combination with the scoop 36 and seams 40 and 42 form a sand scoop. The panel 34 in combination with the scoop 38 and seams 44 and 46 form another sand scoop. Each of the sand scoops is on the bottom side of the panel 34 that comes into contact with the sand while in use.

The use of this version of the device as shown in FIG. 5 is materially similar to the use of the device as shown the earlier figures. To use the device on a sandy surface the user first spreads out the panel 34 with the bottom side having the scoops 36 and 38 down and in contact with the sand. The user can then, starting with a first scoop 36, reach with their fingers on the material of the scoop 36, scoop sand into the area formed between the scoop 36 and panel 34, bounded by the seams 40 and 42. The panel 34 is then tensioned between the first scoop 36 then set into the sand and the second scoop 38. As the panel 34 is pulled smooth and tight the second scoop 38 is anchored in the sand by scooping sand between the scoop 38 and the seams 44 and 46.

Other users find that it is effective to first set the corners between adjacent scoops into the sand sequentially around the perimeter of the device. Then, the long edges of the scoops can be set into the sand to create a tension on the panel between opposing scoops.

This version of the device shown in FIG. 5 is often sufficient to hold onto the sand by using only a single pair of opposing scoops 36 and 38 as compared to having additional scoops on the sides as well. As an alternative to the configuration shown in FIG. 5, a pair of opposing scoops can be on the longer, side edges instead of only being on the head and foot.

Figure 6:
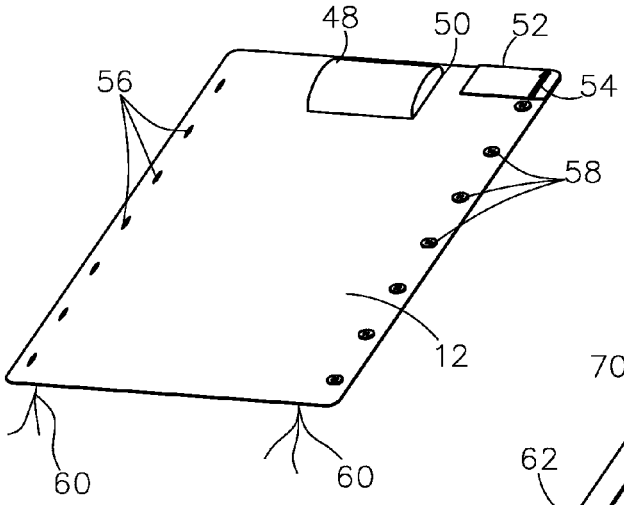
FIG. 6 is a top side plan view of an alternate version of the device.

Now referring to FIG. 6 where several optional features are exhibited on the top side of the panel 12 to include, inter alia, a pillow 48, an opening 50, a pocket 52, a zipper 54, a series of slits 56, a series of buttons 58 and a pair of ties 60.

The pillow 48 is provided to give the user a place to rest their head as well as a place to store bulky items. For example, a shirt, a beach cover-up or other clothing article can be placed inside the opening 50 on the side of the pillow to fill it. The pillow 48 could also have an inflatable bladder to give shape to the pillow 48. Alternately the pillow 48 could be filled with a plush fill material similar to how a traditional pillow would be formed. Optionally the pillow 48 may be removable from panel 12 or may be permanently attached to the panel 12.

Of course, the pillow 48, slits 56 and buttons 58 are possibly located at different areas of the device or may be entirely absent either individually or in combination.

Another version of a pillow feature is embodied in a pocket dimensioned to fit around a pillow affixed to an edge of the panel 12. This allows the pillow feature to essentially hinge about the edge of the panel 12 so that it can be flipped from on top of the panel 12 to immediately adjacent to the panel 12. This version of the pillow may also be dimensioned to fit the users clothes so that these clothes act as stuffing for the pillow.

The pocket 52 is optionally incorporated into the top side of the panel 12. Preferably the pocket 52, if present, has a zipper 54 to seal the contents of the pocket 52. The pocket 52 may be dimensioned to fit, for example, a set of keys, a phone of other personal effects. Preferably the pocket 52 is made of a waterproof material to protect the contents from the incidence of rain or a wet bather.

A series of buttons 58 on one edge of the device are optionally available as a means to attach one copy of the wind-proof beach towel to another copy. The series of slits 56 are on the edge of the panel 12 opposite the series of buttons 58. The slits 56 may be a reinforced similar to a button hole on a common shirt. The slits 56 correspond one-to-one with the respective buttons 58. The buttons 58 are spaced sufficient to prevent the majority of sand from entering the space between adjacent towels yet few enough to avoid tedium when attaching or detaching the series of complimentary connectors.

It should be appreciated that a fastening means other than buttons 58 and slits 56 may be used with efficiency and efficacy. For example, a series of male and complementary female clips, snaps or other similar fixtures may be incorporated into the edges of the panel 12. It may be equally possible to have grommets that are laced, magnets, hook and loop fasteners (known commercially as Velcro) or other commonly available attachment means.

The pair of ties 60, shown at the foot end of the panel 12 may be used to secure the device for transport. The user may roll the panel 12 as well as other non-included items such as a regular towel, dry clothes, beach toys, etc. . . . , and use the ties 60 to secure the roll. Obviously the ties could be constructed of rope, ribbon, belts or other obviously available means to secure the roll.

Although a single person size device is shown in the set of accompanying drawings, it should also be appreciated that the dimensions of the panel 12 may be larger or smaller. For example, a panel size of about thirty inches wide by about seventy inches long may be suitable for a single person. In another example, a two person panel 12 might be about seventy inches square. These specific dimensions are provided only as mere examples and myriad other sizes or variations can equally embody an effective size.

Figure 7:
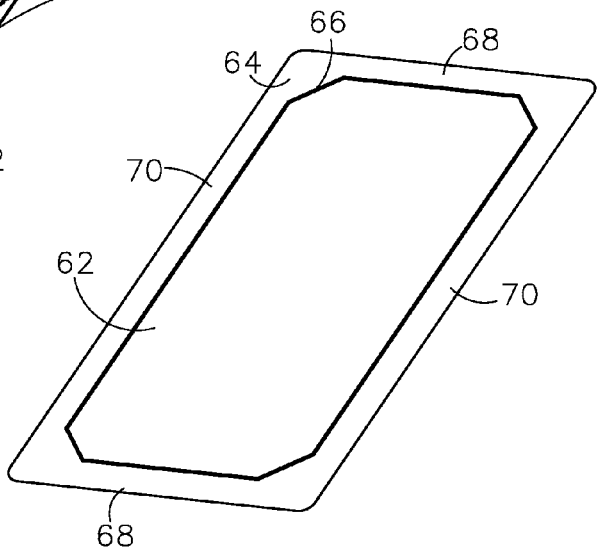
FIG. 7 is a bottom side plan view of yet another alternate version of the device

FIG. 7 shows another variation of the bottom of a panel 62, corner scoops 64, elastic 66, end scoops 68 and side scoops 70. In this version of the device, as in the other versions described supra, the end scoops 68 and side scoops 70 lay flat against the panel 62 when not in use secured to the sand. The main difference between the design shown in FIG. 7 and the other versions are the elastic 66 reinforced end scoops and side scoops 64 between adjacent corner scoops 68 and corner scoops 70. This allows the user to push more sand into the end and side scoops 64 areas to secure the device stronger to the sand.

The elastic 66 may be any stretchable material, preferably incorporated into the edges of the border between the corner scoops 64 and adjacent corner scoops 68. The material attached to the elastic 66 may be bunched up or gathered together to a predetermined degree to essentially allow the corner scoops 64 to have more volume and grip on the sand between the scoops 64 and the main panel for holding more sand, thus providing more weight and grip to secure the device to the ground.

In a preferred version of the device the panel feature is constructed of a stretchable material so that a point on any portion of the panel can be plucked to spring and propel the sand off the edge so that it does not come into contact with a user lying on the device. In contrast, the scoop feature of any of the versions of the device is better performing when it has a limited elasticity or stretchability character. However, the device can remain essentially functional with a wide range of stretchability in each of the subcomponents. Generally, most woven, non-woven, knit, terry and other fabrics perform well. In some versions the material is also better suited with an absorbent character so that it can also be used to dry off the body of the user as a traditional, simple towel.

The dimensions of the several scoops, including for example scoops 16-18 and scoops 68-70, are important to both the ability of the device to be secured to the sand and to the economy of production. A balance must be struck between having too small of a width dimension so that an insufficient amount of sand is captured under said scoops or scoops and too large of a dimension where the scoop or scoop becomes cumbersome and cannot be easily filled with sand. At a minimum, the width of any of the scoops should be about one inch with a preferred performance threshold at about three inches. At a maximum the scoops may be about ten or fourteen inches. A preferred balance for width of the scoops is about three to ten inches.

Figure 8:
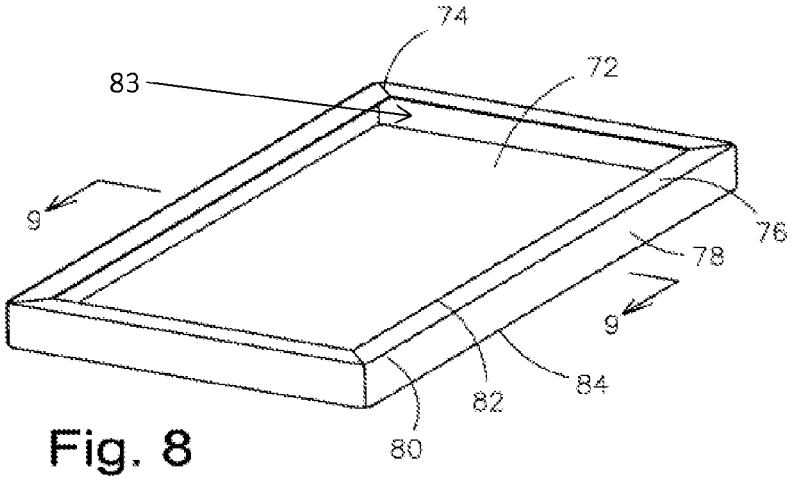
FIG. 8 is a perspective view of an alternate version of the device.
Figure 9:
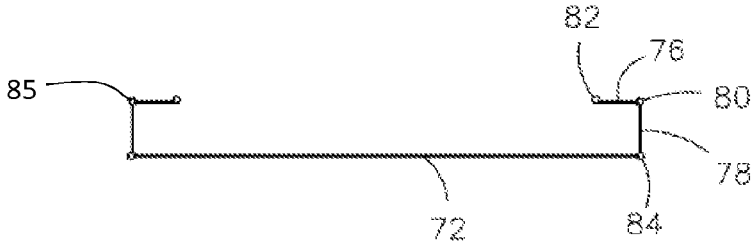
FIG. 9 is a cross-sectional view of the device in FIG. 8.

FIGS. 8 and 9 show a variation of the device that includes, inter alia, a base 72, seams 74, scoops 74, scoops 76, risers 78, seams 80, edges 82 and seams. The SCOOPS 74 and scoops 76 can be seen inwardly disposed in a direction toward a center of the base 72 (exemplified in FIG. 8). The risers 78 and the scoops 74 and scoops 76 form an inwardly facing channel 83 adapted to retain an amount of sand therein. These figures demonstrate optional features that generally include the added depth provided by the risers 78 that are around the periphery of the base 72. The risers 78 separate the base 72 from the scoops 76 thereby strengthening the device's bond to the sand.

Each of the scoops 76 have along one long side an edge 82 and along the other are affixed to the riser 78 at a seam 80. In turn, the riser 78 is affixed to the periphery of the panel 72 at seam 84. At the intersection between adjacent scoops 76 are seams 74 that connect the adjacent scoops 76.

In a preferred version each of the seams 74, 80, and 84, the edge 82 and the panel 86 are each treated with piping 85 to give a degree of structure to those parts. The piping 85 is shown more clearly in the cross-section in FIG. 9 at the cross-section indicators in FIG. 8. The piping 85 can aid the user in setting up the device and filling the scoops 76 with sand. The piping 85 is has a degree of rigidity but is not still and allows the entire device to still roll, fold or pack tightly for storage and transport. Typically, the piping 85 could be manifested in a roll of material, bunch of thread, string, filing, cover or other materials and method in the common art to reinforce the seams of the device.

Whether the design includes a riser 78 or is in a flat configuration as the variety of the device as shown in FIG. 1, the intersection between scoops, such as scoops 76 or scoops 14-18, may optionally have a mitered joint either with or without a piping element. All seams may have optional piping.

Figure 10:
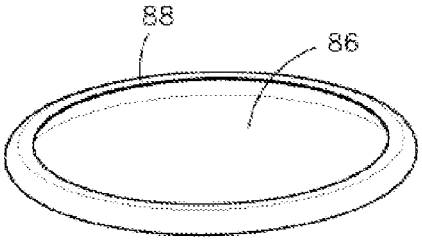
FIG. 10 is a perspective view of an alternate configuration of the device.

FIG. 10 is an example principally demonstrating an alternate configuration of a panel 86 shown in combination with a scoop 88. A panel 86 can have virtually any shape, including those with curvy or straight perimeters. Generally, and in most circumstances, the scoop 88 will match and follow the dimensions of the perimeter of the panel 86. The scoop 88 is affixed to the panel 86 at the perimeter of the panel 86 thereby creating a scoop 88 that is adapted to scoop under the sand upon which it is placed to secure it to the ground.

The application of this concept can be to have a panel that is a particular shape of significance. For example, the panel 86 could be made to resemble to silhouette of an animal, a corporate or sports team logo or mascot. Other shapes can be equally effective such as geometric shapes or a series of amorphous curved segments combined in an amoebic-like form factor.

The referenced configurations can each be constructed with or without an equivalent to the riser 78 shown in FIG. 8 or may be a flat construction as demonstrated in FIG. 1.

Figure 11:
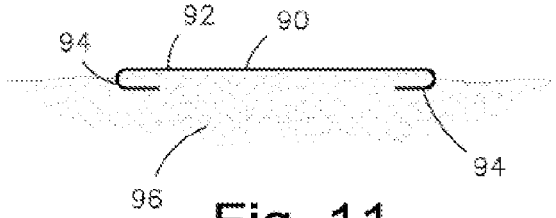
FIG. 11 is a cross-sectional view of a version of the device in use on a sandy surface.

FIG. 11 is a cross-section of a variation of the device to show more clearly how the device is configured for use on a sandy surface, such as a beach to include, inter alia, a point 90, a panel 92, scoops 94 and sand 96. Sand is scooped into the scoops 94 to tension the panel 90 between the scoops 94. Each of the variations of the device is applied to the sand in a similar way.

Generally, and depending on the overall shape of the panel 92, scoops 94 on opposite sides have an arbitrary point 90 near the mid-point between the scoops 94. Once the device is set into the sand and the scoops 94 are filled with sand to create tension, the point 90 may be grasped by the fingers and plucked to spring any errant sand on top of the panel 92 off of the edge of the panel 92, past the scoops 94 and off of the edge and back onto the beach proper.

Yet referring to FIG. 11, a preferred use of the device is scoop sand 96 underneath the panel 92 so that it is slightly elevated above the surrounding level of sand 96. This allows any sand that is on the top of the device to be more easily shed off the sides with the aid of gravity. It also has the added benefit of reducing the amount of low, blowing sand from being able to land on the top of the device. The slight elevation difference also enables the plucking method described above to be more effective at removing all traces of sand from the top of the panel.

The tension between the scoops 94 (or any of the other versions of scoops) allows a user to easily walk on the top of the blanket without significant deformation of the sand underneath or displacement of the edge of the panel. Sand can also be easily brushed off or naturally blown off the edge by the prevailing breeze. Once set by tension, readjustment is not necessary because the device stays where it has been anchored. For larger versions of the device a build-up of sand under only the periphery of the blanket without necessarily a build-up under the entire panel will suffice to provide the added benefits of a raised edge while still permitting tension between opposing scoops.

It should be appreciated that the differences in elasticity of materials, cost of materials and the density of the sand onto which the device will be secured may all factor in to the preferred dimensions of the width of the scoops. The width of the scoops for a single design need not be all the same width. For example, the head and foot may benefit from a wider scoop and the sides a narrower width may be sufficient for best performance.

Figure 12:
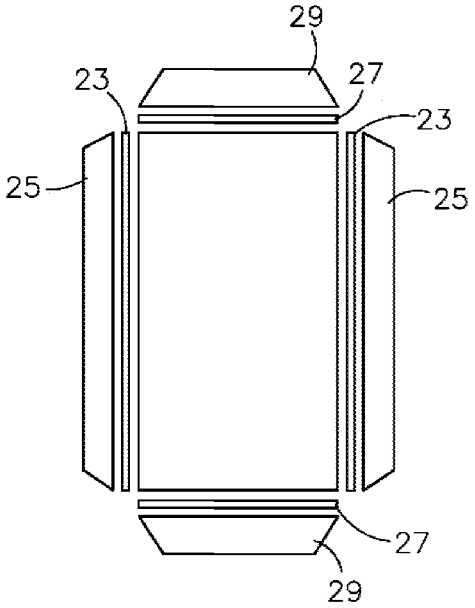
FIG. 12 is an exploded plan view of a version of the device.

Referring now to FIG. 12 where an exploded view of the device is shown to include, among other elements, risers 23, scoops 25, risers 27 and scoops 29. This view is an example of a possible cut and assembly pattern that could be used during the fabrication of the device. Each of the elements of this view can be affixed together, typically by stitching and may include optional piping between some or all of the elements. The dimensions of the risers 23 and 27 as well as the scoops 25 and 29 may be adjusted to balance the distance under the sand that the device is anchored.

Figure 13:
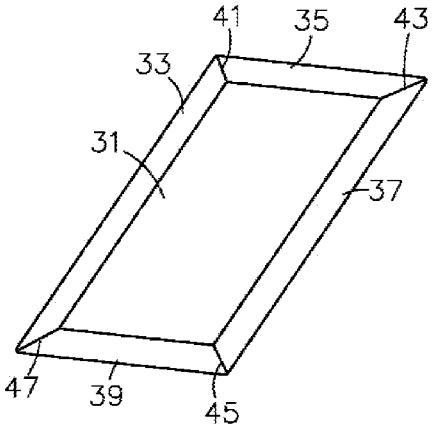
FIG. 13 is a perspective view of an alternate version of the device.

FIG. 13 is provided to show an alternate version of the device, particularly the orientation of seams that includes, among other elements, a panel 31, a scoop 33, a scoop 35, a scoop 37, a scoop 39, a seam 41, a seam 43, a seam 45 and a seam 47.

Similar to other versions of the device there is a panel 31 and a series of scoops 33, 35, 37 and 39 affixed about the periphery of the panel 31. Scoops 33 and 35 are joined at a mitered seam 41. Scoops 35 and 37 are joined at a mitered seam 43. Scoops 37 and 39 are joined at a mitered seam 45. Scoops 39 and 33 are joined at a mitered seam 47.

Figure 14:
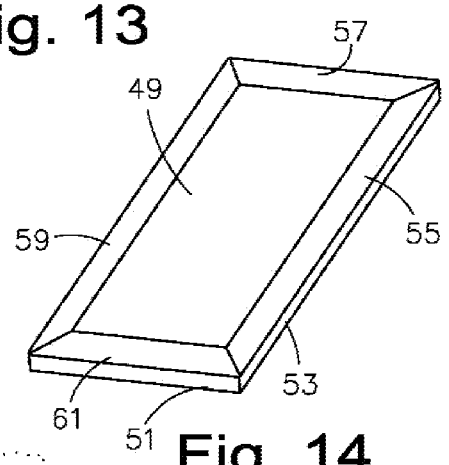
FIG. 14 is a perspective view of an alternate version of the device.

There are optionally risers 51, 53 and the unseen complement to these elements that are demonstrated in FIG. 14 that can provide a degree of depth to the scoops. By including these risers in addition to the scoops 55, 57, 59 and 61 the amount of sand that can be used to anchor the device is adjustable. For reference the bottom side of the panel 49 is also identified.

Figure 15:
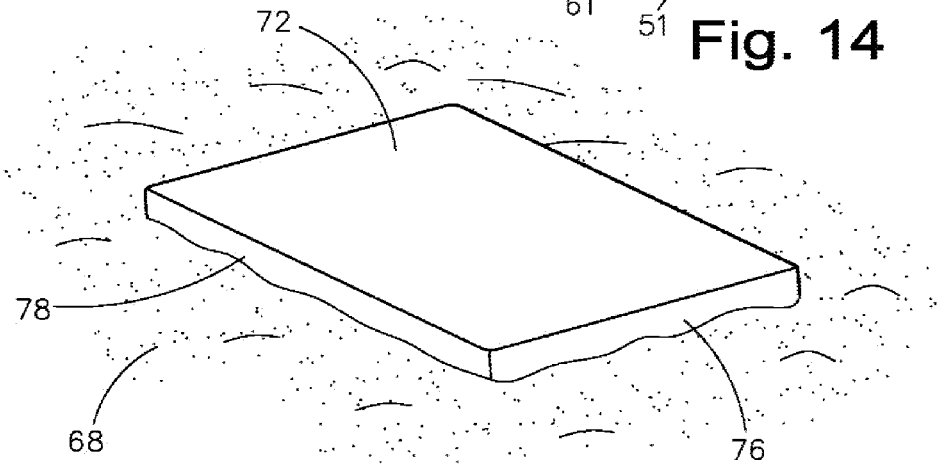
FIG. 15 is a perspective view of the device as it may be in actual use.

FIG. 15 shows a view of the device as it might in actual use anchored to sand 68. Visible in this view are the top of the main panel 72, scoop 76 and riser 78. All edges of the panel 72 have scoops and optionally risers as shown in other figures and described herein. As can be seen in this figure the device is anchored into the sand 68 with the top surface of the panel 72 adjusted to be slightly higher than the surface of the sand. This aids in preventing sand from getting onto the surface of the panel 72 as well as removing any sand that finds its way onto the panel 72.

The invention disclosed herein can also fairly be described as a beach blanket comprising a main panel having a top side, a bottom side, a first edge, a second edge, a third edge and fourth edge. The main panel is doubled over to a predetermined width forming a scoop onto said bottom side of said main panel at said first edge to form a first scoop and at second edge to form a second scoop and at said third edge to form a third scoop and at said fourth edge to form a fourth scoop. The first scoop and third scoop have an approximate width of between one and fourteen inches. This dimension could be more or less depending on the makeup of the soil and size of the blanket. The second scoop and fourth scoop having an approximate width between one and ten inches and can be similarly adjusted in size. A first seam connects said first scoop to said second scoop at the intersection between the first scoop and the second scoop. The seam can be mitered on a forty five degree angle or other aesthetically pleasing or strong angle. A second seam connects the second scoop to the third scoop at the intersection between the second scoop and the third scoop. A third seam connects said third scoop to said fourth scoop at the intersection between said third scoop and said fourth scoop. A fourth seam connects said fourth scoop to said first scoop at the intersection between said fourth scoop and said first scoop. The main panel is formed of a flexible and absorbent fabric, possibly terry cloth, cotton, woven or unwoven, knitted, plastic coated (liner) or other commonly available material.

An important option includes a plurality of first fasteners are along the first edge and a plurality of second fasteners are along the third edge. The first and third edges are opposite or possibly adjacent sides, depending on the effect the manufacturer is going for. For example, the blankets could be connected side by side or end to end or end to side. The fasteners and are adapted so that said first fasteners on a first beach blanket selectively attach to said second fasteners on a second beach blanket resulting in the joining of said first beach blanket joined to said second beach blanket at their respective edges forming a larger, rectangular or other shaped beach blanket. These fasteners might be buttons and button holes, hook and loop fasteners, clips or other available means to attach one device to another.

Optionally, a pillow can be integrated into the design at the first end on said top side on the edge seam. Also optionally, elastic gussets that reinforce the seams may be included in the corners or where further reinforcement is needed.

Some versions of the device may also include one or more sealable pockets is included on the top side of the main panel. These can be used to store a phone, keys or other accoutrements of a beach trip.

The beach blanket can be further characterized as having a panel (main top surface) that is comprised of a main panel having on its top side an absorbent layer having a nap (i.e. a terry cloth or French terry) and on said bottom side having a smooth layer adapted to resist the adherence of sand (i.e. a tightly woven fabric or plastic laminate).

The invention can also be fairly described as being a beach blanket comprising a main panel and a sand scoop. The main panel has a top surface, a bottom surface and a perimeter edge. Generally, the user lays on the top surface while the bottom surface is against the sand. The sand scoop is affixed to, or integrated along, a first edge of the perimeter edge of the main panel and lays against the bottom surface of said main panel. The sand scoop is adapted and configured to contain a soil to act as an anchor at substantially the perimeter of said main panel by scooping and containing sand along and under the perimeter of the main panel. The sand scoop generally has a width of between two and fourteen inches. The main panel is preferably constructed of a fabric having a predetermined degree of stretchiness and adapted to resist the adherence of soil. However, the sand scoops are constructed of a material that is substantially stretch-free.

The device is typically set up using a method of securing the beach blanket to a preselected area of sand by: spreading a bottom side of said beach blanket onto said sand with the beach blanket having a sand scoop about a periphery of said beach blanket on said bottom side. The user then at an initial point on said periphery of said beach blanket reaches with a hand under said sand scoop and filling said sand scoop with sand. At a subsequent point a predetermined interval from said initial point again fill sand scoop with sand. The user continues filling additional sand scoops at repeated subsequent intervals until the entire sand scoop is full of sand. The tension is imparted onto the main panel between a plurality of opposing point pairs which results in a very secure setup.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A beach blanket comprising:

a laterally disposed base made of a first material having two sets of opposed sides, each of the two sets of opposed sides having a riser coupled thereto by a first seam;

an inwardly disposed trapezoid-shaped scoop made of a second material different than the first material, the second material of an elasticity less than an elasticity of the first material, the second material configured to strengthen a bond between the inwardly disposed trapezoid-shaped scoop and an amount of sand, the inwardly disposed trapezoid-shaped scoop coupled to each riser by a second seam, the riser and the scoop together forming an inwardly facing channel adapted to retain the amount of sand therein; and a third seam coupling each inwardly disposed trapezoid-shaped scoop to an inwardly disposed trapezoid-shaped scoop on an adjacent side of the base.

2. The beach blanket according to claim 1, wherein the laterally disposed base further comprises:

a body-supporting surface and a sand-contact surface, the inwardly facing channel being disposed on the sand-contact surface.

3. The beach blanket according to claim 2, wherein:

the body-supporting surface and the sand-contact surface are constructed of a single layer of material.

4. The beach blanket according to claim 1, wherein:

a piping is integrated into a portion of the laterally disposed base.

5. The beach blanket according to claim 1, wherein the laterally disposed base further comprises:

a pair of ties located on a perimeter of the beach blanket.

6. A method of securing a beach blanket to a preselected area of sand, the method comprising the steps of:

providing a beach blanket having:

a laterally disposed base made of a first material including two sets of opposed sides, each of the two sets of opposed sides having a riser coupled thereto by a first seam;

an inwardly disposed trapezoid-shaped scoop made of a material different than the first material of the base, the material of an elasticity less than the first material, the material configured to strengthen a bond between the inwardly disposed trapezoid-shaped scoop and an amount of sand, the inwardly disposed trapezoid-shaped scoop coupled to each riser by a second seam, the riser and the scoop together forming an inwardly facing channel adapted to retain the amount of sand therein; and a third seam coupling each inwardly disposed trapezoid-shaped scoop to an inwardly disposed trapezoid-shaped scoop on an adjacent side of the base; and anchoring the beach blanket to a preselected area of sand by at least partially filling the channel with sand.

7. The method of claim 6, wherein the beach blanket further comprises:

a body-supporting surface and a sand-contact surface, the channel being on a side of the base closest to the sand-contact surface.

8. The method of claim 7, further comprising:

grasping the beach blanket from a center point of the body-supporting surface; and lifting the beach blanket a distance from the preselected area, the distance operable to remove any existing sand from the body-supporting surface and allow the channel to remain secured to the preselected area of sand.

9. The method of claim 6, further comprising:

providing a pair of ties at a perimeter of the beach blanket;

rolling the beach blanket; and securing the perimeter of the beach blanket with the pair of ties.

10. A beach blanket comprising:

a base made of a stretchable material having two sets of opposed sides, each of the two sets of opposed sides having a riser coupled thereto to by a first seam;

an inwardly disposed trapezoid-shaped scoop made of a material having less elasticity than the material of the base, the inwardly disposed trapezoid-shaped scoop coupled to each riser by a second seam, the material of the inwardly disposed trapezoid-shaped scoop configured to strengthen a bond between the inwardly disposed trapezoid-shaped scoop and an amount of sand, the riser and the inwardly disposed trapezoid-shaped scoop together forming an inwardly facing channel adapted to retain the amount of sand therein; and a third seam coupling the inwardly disposed trapezoid-shaped scoop on a first side of the base to an inwardly disposed trapezoid-shaped scoop on a second adjacent side of the base, the third seam being indirectly coupled to the base.

* * * * *